United States Patent [19]

Tobias et al.

[11] 4,253,816

[45] Mar. 3, 1981

[54] POWERED JOINT FORMING DEVICE FOR CONCRETE OR THE LIKE

[76] Inventors: Luther Tobias, 4012 Lower Wyandotte Dr., Oroville, Calif. 95965; David G. Bories, 8421 Ascolano Ave., Fair Oaks, Calif. 95628

[21] Appl. No.: 65,770

[22] Filed: Aug. 13, 1979

[51] Int. Cl.[3] ..... B28B 1/04; B28B 1/08; B29C 23/00

[52] U.S. Cl. ..... 425/385; 404/74; 404/89; 404/114; 425/445; 425/456; 425/457

[58] Field of Search ..... 264/69, 333; 425/62, 425/87, 289, 302.1, 304, 324.1, 385, 445, 446, 456, 457, 458, 469, 219, 432, 59; 404/98, 105–106, 87, 89, 74, 114

[56] References Cited

U.S. PATENT DOCUMENTS

| | | | |
|---|---|---|---|
| 1,726,665 | 9/1929 | Heltzel | 404/89 |
| 1,946,972 | 2/1934 | Heltzel | 404/89 |
| 1,996,153 | 4/1935 | Heltzel | 404/87 |
| 2,098,870 | 11/1937 | Heltzel | 404/89 |
| 2,486,422 | 11/1949 | Kies | 404/89 |
| 2,617,336 | 11/1953 | Brickler | 404/89 |
| 2,644,378 | 7/1953 | Nelson | 404/89 |
| 2,949,068 | 8/1960 | Griesham | 404/89 |
| 3,194,130 | 7/1965 | Guntert | 404/89 |
| 3,286,607 | 11/1966 | Middlestadt | 404/89 |
| 3,478,655 | 11/1969 | Rasmussen | 404/89 |
| 4,027,990 | 6/1977 | Merrill | 404/98 |
| 4,032,249 | 6/1977 | De Vitis | 404/89 |

*Primary Examiner*—W. E. Hoag
*Attorney, Agent, or Firm*—Mark C. Jacobs

[57] ABSTRACT

A powered jointer having a scoring undersurface for forming a stress joint in a wet concrete slab, followed by a reciprocating tamper foot which forms a stress joint while moving rock out of the joint and a smoothing tip following the formation of the stress joint for smoothing out the same, all in a single pass.

10 Claims, 9 Drawing Figures

POWERED JOINT FORMING DEVICE FOR CONCRETE OR THE LIKE

BACKGROUND OF THE INVENTION

1. Field of the Invention

The invention relates to a power tool; and, more particularly, to a power tool for grooving a weakened plane joint into a wet concrete slab.

2. Description of the Prior Art

In the past, cement contractors have used trowels, edgers or groovers or jointer-type hand tools to make weakened plane joints in wet concrete slabs. The prospective groove is lined up with a two-by-four guide. Such a prior art jointer, usually on an elongated handle, is run along the guide while the concrete is still partially wet. This initial trowel action moves aside the rocks and bulky concrete mix. After the concrete has slightly hardened, the trowel action is repeated. The second trowel action sharpens and finishes the cut of the weakened plane joint. Such hand tools, by virtue of their use, are not efficient and time consuming.

Althrough many such jointers are known, there is a need for a jointer that does not require the use of a two-by-four or other manual means as a guide. If such need is eliminated, much time will be saved since contracting time is very valuable. There is also a need for a jointer which carries out two actions at once; moves rocks and cuts a groove. Also, such a jointer should cut the groove in a single pass, not two passes as required by prior art jointers. This, of course, in addition to saving valuable time, makes the jointer more efficient.

There is thus a need for a powered jointer which can be used to form a weakened plane-joint in building patios, sidewalks and driveways in a single pass without the need for setting up two-by-fours or other manual means as a guide. Such a jointer should be able to be operated simply so as to be able to be used by both professional contractors and private parties.

SUMMARY OF THE INVENTION

It is an object of this invention to provide a powered cement jointer for grooving a weakened plane joint into a wet concrete slab in a quick and efficient manner.

It is a further object of this invention to provide such a jointer which grooves the joint in a single pass and without the need for a path former, such as two-by-fours or the like.

It is still further an object of this invention to provide a jointer which carries out two actions at once, move rocks and cut a groove.

It is even a further object of this invention to provide such a jointer which can be used by both professional contractors and private parties.

These and other objects are preferably accomplished by providing a powered jointer having a ridged undersurface for forming a stress joint in a wet concrete slab, followed by a reciprocating tamper foot which forms a stress joint while moving rock out of the joint and a smoothing tip following the formation of the stress joint for smoothing out the same, all in a single pass.

DESCRIPTION OF THE PREFERRED EMBODIMENT

Figure 1:
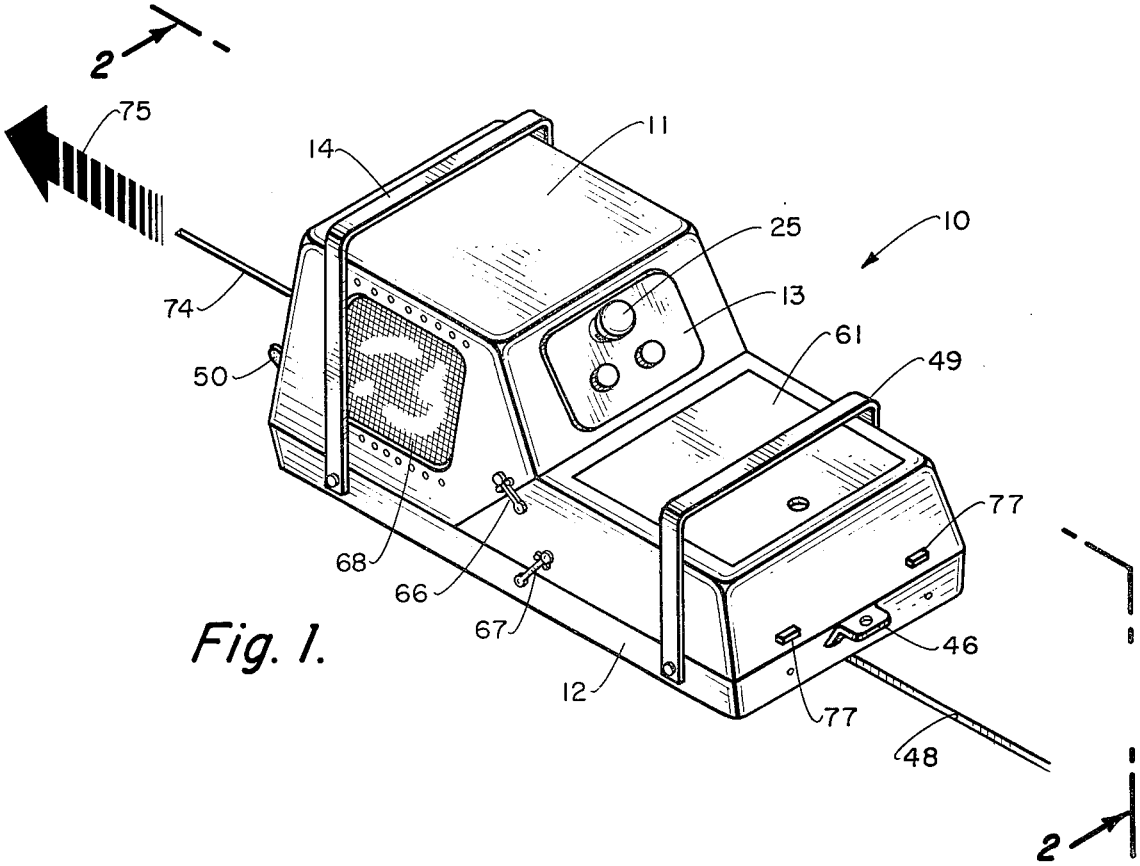
FIG. 1 is a perspective view of a jointer in accordance with the invention.
Figure 2:
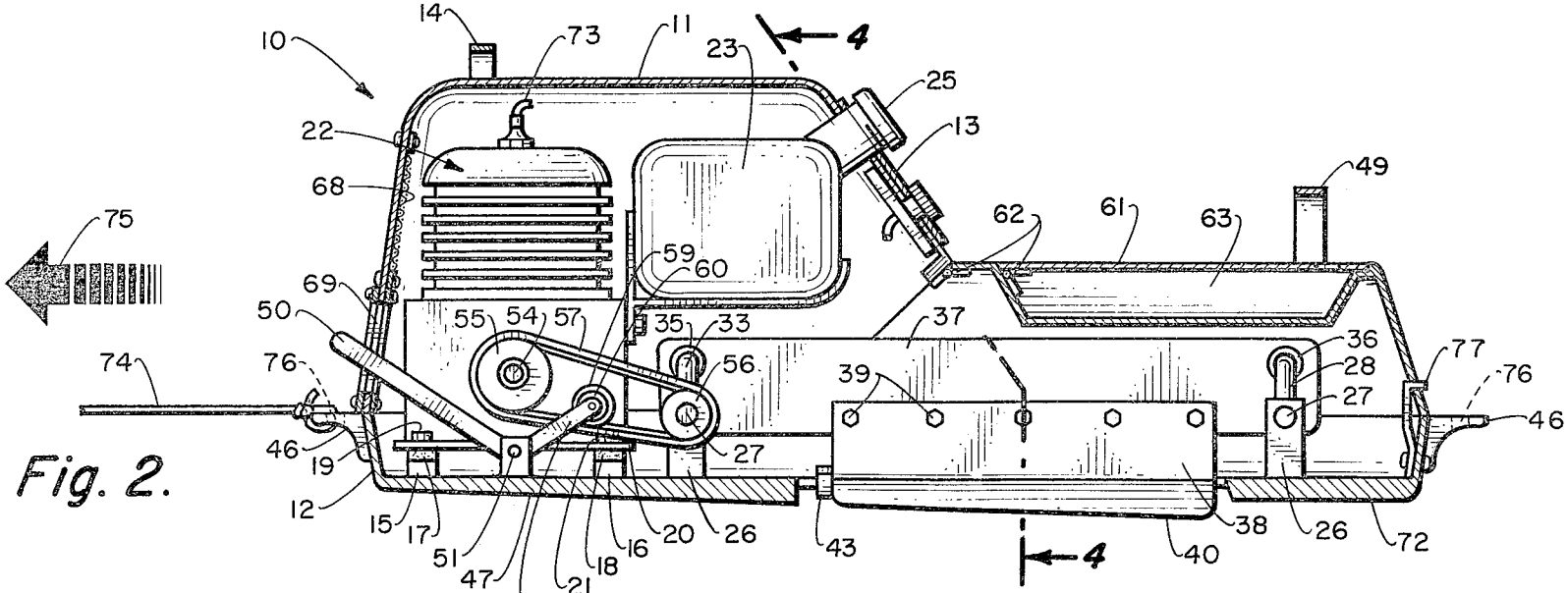
FIG. 2 is a cross-sectional view of the jointer of FIG. 1 taken along the lines II—II thereof.

Referring now to FIG. 1, a powered cement jointer 10 in accordance with the invention is shown having an upper housing 11, a lower housing 12, a control panel 13 on the upper housing 11 and a handle 14. As shown in FIG. 2, lower housing 12 includes transverse ribs 15,16 which may be formed or molded with the lower housing 12 and having resilient mounts, such as rubber mounts 17,18, mounted on ribs 15,16, respectively. As will be discussed, mounts 17,18 reduce motor vibration. Bolts 19,20 mount the lower bracket 21 of motor 22 to mounts 17,18, respectively. Of course, similar bolts (not visible) may be used to mount bracket 21 to ribs 15,16, on the side of jointer 10 not visible in FIG. 2.

Figure 4:
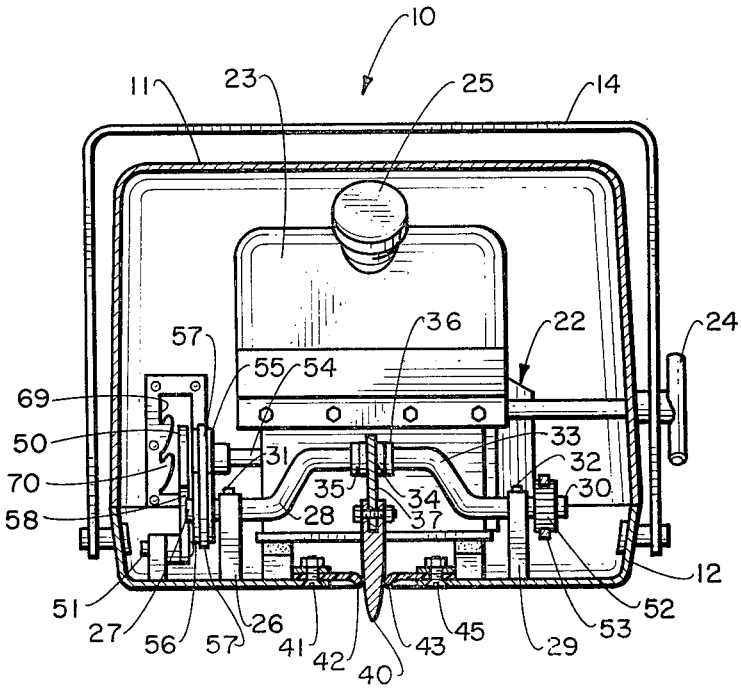
FIG. 4 is a view taken along lines IV—IV of FIG. 2.
Figure 8:
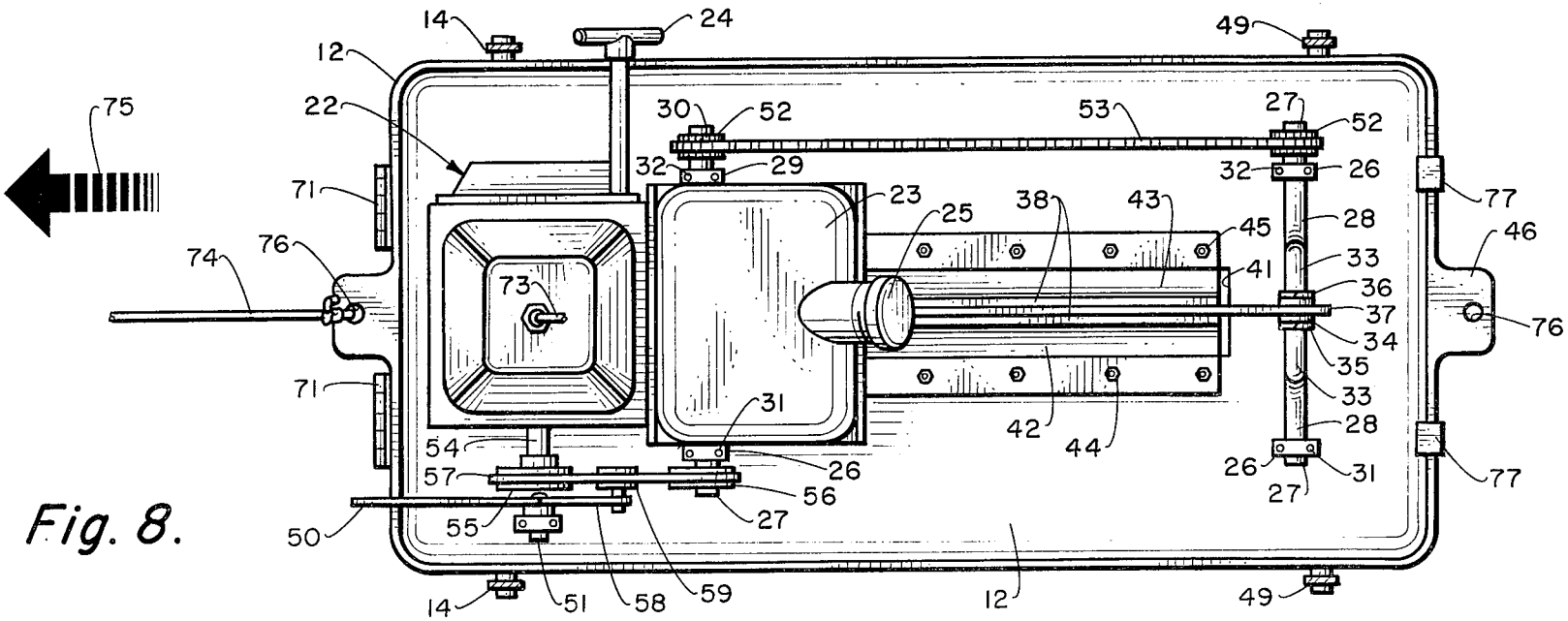
FIG. 8 is a top view of the jointer of FIG. 1 with the cover removed.

The power means for jointer 10 is provided by a conventional internal combustion engine or motor 22 which includes a fuel tank 23, a pulling starter 24 (see FIG. 3), and a fill cap 25 for tank 23. Lower housing 12 also includes an upstanding mount 26 having a bearing 27 journalled for rotation therein. Crankshaft 28 (see particularly FIG. 4) extends transverse of lower housing 12 connected to bearing 27 for rotation. As can be seen in FIG. 4, a similar mount 29 and bearing 30 is mounted on housing 12 on the side opposite mount 26 and bearing 27, crankshaft 28 thus being journalled for rotation with bearings 27,30. Also, a similar crankshaft 28, with similar mounts 26 and bearings 27, is mounted at the front and rear of jointer 10, as seen in FIGS. 2 and 8. Bearings 27,30 may be of brass and secured to mounts 26,29 by suitable bolts 31,32.

Crankshaft 28 may be of steel or the like and formed with a central U-shaped portion 33 as shown in FIG. 4. The center of portion 33 passes through a tamper bearing 34, of brass or the like, held in place by a pair of clips 35,36 mounted on the opposite sides of a mounting bar 37 fixed to crankshaft 28. Bar 37 may be generally flat and of steel or the like having a tamper foot 38, generally triangular in cross-section (FIG. 4) secured thereto by one or more bolts 39 (see FIG. 3). The lowermost end of foot 38 tapers to a point 40 extending beyond the plane of the bottom of housing 12 for reasons to be discussed. Foot 38 may be made of cast iron, steel or other ferrous material.

An opening 41 is provided in housing 12 through which point 40 extends (FIG. 4). A pair of resilient wiping pads 42,43, are bolted, via bolts 44,45, to housing 12 meeting point 40 providing a wiping action. The pads 42,43 may be made of rubber and both clean foot 38, by wiping thereagainst, and seal the bottom of housing 12 from the cement being surfaced.

A lanyard eye 46 is mounted on each end of jointer 10 for attaching a flexible line or lanyard to jointer 10 to control linear movement thereof.

The underside of housing 12, before foot 38, may be ridged at 47 (see also FIG. 5) thus forming a stress joint in the concrete surface before foot 38 forms the groove 48 (see FIG. 1).

A pair of handles 14,49 are provided on the front and rear of jointer 10. A clutch handle 50 is shown in FIG. 2 as pivotally mounted via pin 51 to housing 12, as will be discussed.

Figure 3:
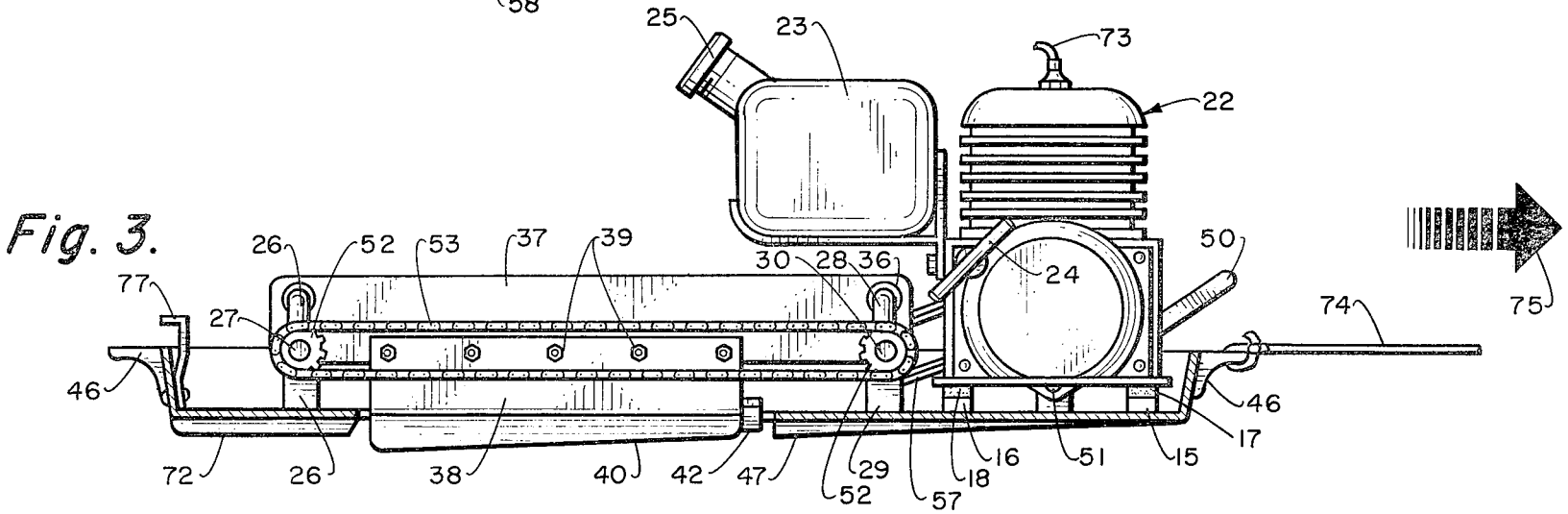
FIG. 3 is a view, similar to FIG. 2, from the opposite side thereof, with components omitted for convenience of illustration.

As shown in FIGS. 3 and 8, a chain and sprocket drive is provided between the front and rear crankshafts 28. Thus, front sprocket 52 is journaled for rotation to front bearing 27 with chain 53 engaging a like rear sprocket 52. Rotation of front sprocket 52 will thus rotate the rear sprocket 52 via chain 53 driving both crankshafts 28.

Motor 22 rotates a drive shaft 54 (FIGS. 2 and 8) which in turn rotates drive pulley 55. A smaller driven pulley 56 is mounted for rotation on bearing 27 adjacent motor 22 with V-belt 57 engaging both pulleys 55,56 for transmitting rotation via motor shaft 54 to pulley 55 and to pulley 56.

Figure 6:
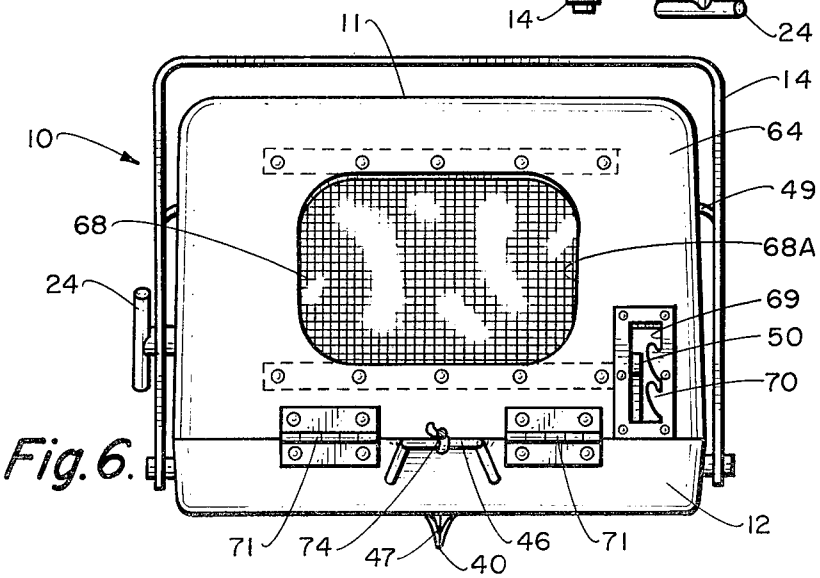
FIG. 6 is a rear view of the jointer of FIG. 1.

A clutch assembly is provided which includes handle 50. Handle 55 includes an integral pulley actuating section 58, extending angularly therefrom, having a clutch pulley 59 journalled thereon via bearing 60. It can be seen that, by selectively raising and lowering handle 50, pulley 59 engages V-belt 57 to take up the slack and thus act as a clutch. If desired, housing 11 may include indexing means (FIG. 6) in the form of a slot 69 having indexing points 70 therein for engaging handle 50 thus indicating proper catch points for engaging V-belt 57.

Figure 7:
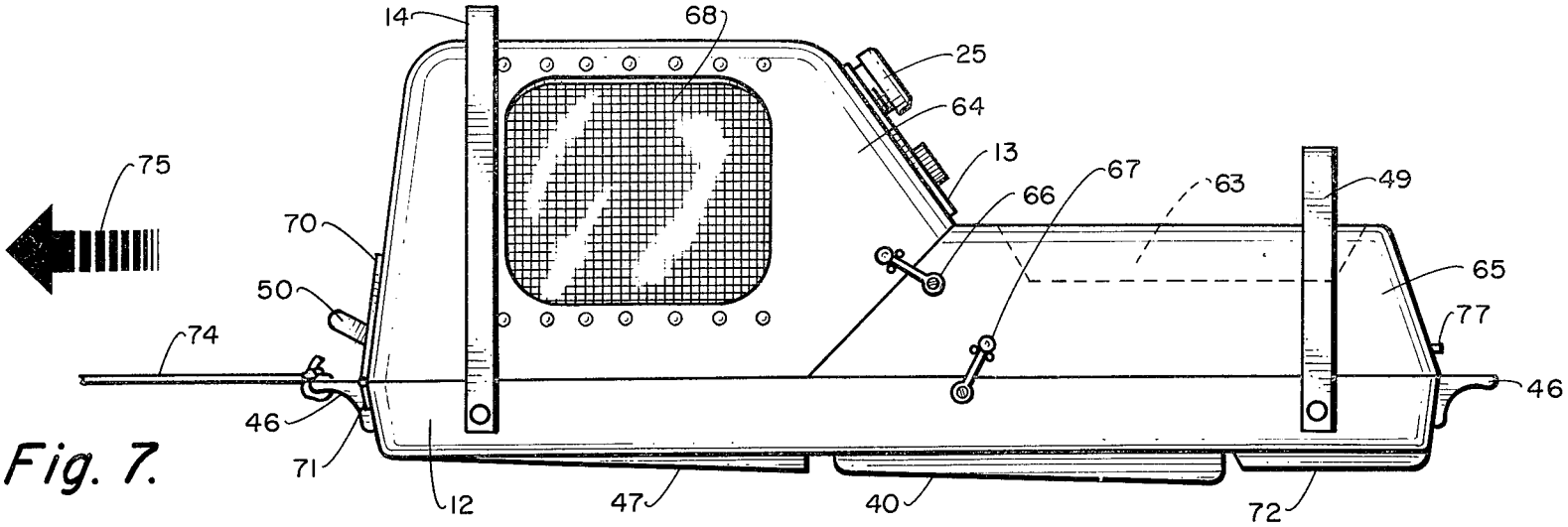
FIG. 7 is a side view of the jointer of FIG. 1.

Upper housing 11 includes a cover assembly 61 (FIG. 7) hingedly connected, via spring loaded hinge 62, to housing 11. Cover assembly 61 closes off a compartment 63 for storing a lanyard (not shown in FIG. 7) therein for connection to eyes 46 for moving jointer 10. The portion 64 of housing 11 covering motor 22 may be of molded fiberglass as may be the portion 65 enclosing tamper foot 38. Portion 64 may be secured to portion 65 by conventional resilient stretch and catch fasteners 66,67. One or more screens 68 may cover openings in portion 64 enclosing motor 22 to provide ventilation (see also FIG. 6). Cover portion 64 may be hinge connected to lower housing 12 via hinges 71 (see FIGS. 2, 6 and 7). A smoothing tip 72 (FIG. 5) is provided via a double trowel rearwardly of tamper point 40 for smoothing out the formed groove and a conventional grounding strap 73 (FIG. 2) may be connected to the motor 22 and grounded in any suitable manner.

Figure 5:
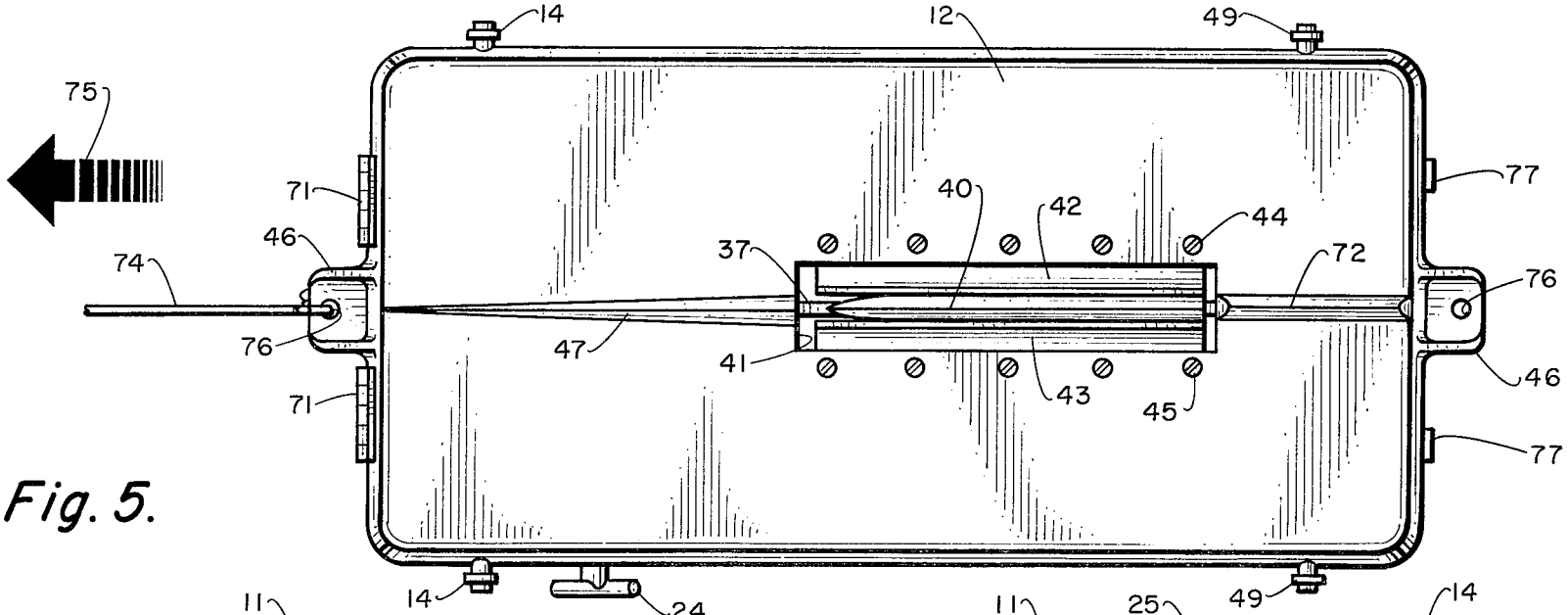
FIG. 5 is a bottom view of the jointer of FIG. 1.

In operation, a lanyard 74 (FIG. 2) is attached to eye 46 and jointer 10 is pulled via lanyard 74 in the direction of arrow 75 (see also FIGS. 1, 3, 5, 7 and 8). As seen in FIG. 5, ridged portion 47 forms a stress in the concrete whereas tamper point 40 forms the joint itself, tip 72 serving to smooth out the formed groove (e.g., groove 48 in FIG. 1.). Pull starter 24 is used to actuate motor 22 thus rotating drive shaft 54 which rotates pulley 55. Pulley 56 is thus also rotated, via belt 57 which rotates front sprocket 52 to drive chain 53 and rotate the rear sprocket 52 thereby rotating rear crankshaft 28 in its bearings 27. Tamper foot 38, connected to both crankshafts 28 via bar 37, reciprocates thereby moving impacted rocks forcing them aside while providing a forward movement to jointer 10.

Jointer 10 is thus a semi-self-propelled device which grooves a plane joint, weakened by ridged portion 47, into a fresh concrete slab, with smoothing tip 72 smoothing out the formed joint. Motor 22 may be a conventional two-stroke gasoline actuated engine. Tamper foot 38 reciprocates thereby impacting rock in the cement aggregate forcing them aside and simultaneously providing forward motion to jointer 10. Tamper foot 38 operates in slot 41 with the housing being ridged at portion 47 to groove a joint with foot 38, having the same contour as portion 47, operating in line with the ridge or portion 47.

The various parts of jointer 10 may be of steel, cast iron, and other suitable materials. Foot 38, portion 47 and tip 72 may be of hardened steel. All iron and/or steel components may be zinc coated and painted, if desired. Holes 76 in eyes 46 may be chamfered, if desired, to prevent cutting of the lanyard 74. All rotating connections may have sealed anti-friction bearings.

The control panel 13 (FIG. 1) may have suitable power on-off switches, speed control dials, tamper foot engaging lever dial, fuel cap 25, etc. Handles 14 and 49 are used to transport jointer 10. Eyes 46 permit jointer 10 to be pulled in either direction.

The ridged portion 47 creates a weakened groove or stress joint with the actual joint being formed by tamper point 40, followed by indenting of a weakened plane groove into the wet concrete slab via tip 72. This dual action results in a greater polishing and smoothing of the weakened plane joint.

It can be seen that there is disclosed a unique and semiautomatic means for forming a plane joint in a wet concrete slab in a single pass without the need for manual use of a guide, such as a two-by-four.

While handle 14 can be used for carrying the device of this invention during periods of non-operation, it is also to be seen that proper dimensioning of the handle 14 will permit the operator to insert a long board such as a 2 by 4 under handle 14 to remove the device from the cement being finished. Due to the weight of the device 10, it may be beneficial to employ two persons to do so.

While a pull starter 24 has been disclosed, obviously it is within the scope of this invention to use a more automatic starting mechanism such as a button or keystart as are found in lawn mowers and boats.

While not specifically shown in the drawings, it is within the scope of the invention to include a grounding lug such as is found in gas powered lawnmowers on control panel 13, to allow the operator to stop the device 10 during its operation, in case an erratic course if being followed by accident, or for some other reason. Ground lugs and switches to stop motors are well understood in the art.

Figure 9:
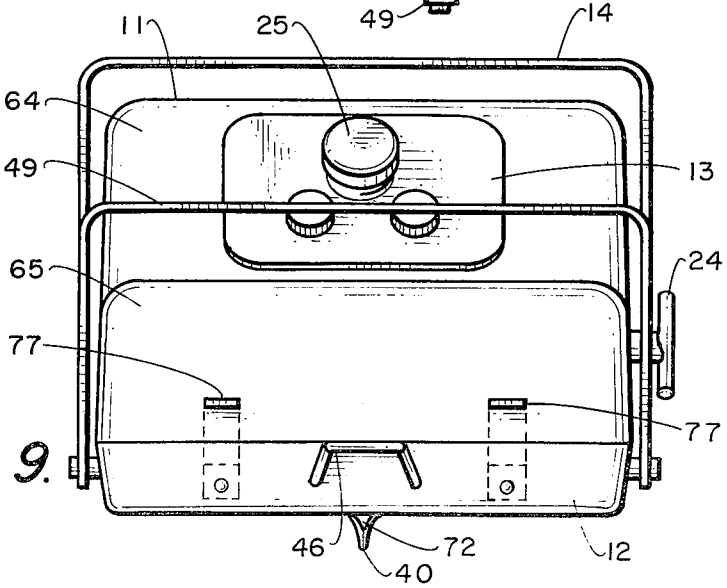
FIG. 9 is a front view of the jointer of FIG. 1.

It is to be seen that screen 68 may be attached as in FIG. 9 to the body portion 64 by any conventional means such as bolts or rivets passed through the portion 64 and screen 68. Optionally a reinforcing member not shown may be employed laterally at the top and bottom edges of the opening 68A covered by the screen 68.

While previously described as to structure, it is seen that handle 50 acts as a safety mechanism to put tension on the tension pulley 59 thereby preventing the belt 57 from driving pulley 56 which is the driving force for the device.

Thus, if the operator desires access to motor 22 as for service, raising of upper housing 11 causes handle 50 to release the tension thereby presenting the driving of pulley 56 as was discussed above.

I claim:

1. A motor driven jointer for forming a groove in wet concrete slab comprising:

a housing;

a motor contained within said housing;

stress joint preforming means for preforming a stress joint in a wet concrete slab on the underside of said housing adjacent the forward edge thereof; and reciprocating tamper foot means actuated by said motor reciprocating in an opening in the underside of said housing rearwardly of said stress joint preforming means for forming a stress joint in wet concrete slab.

2. In the jointer of claim 1 wherein said stress joint preforming means includes a ridged portion on the underside of said housing.

3. In the jointer of claim 1 including joint smoothing means on the underside of said housing aligned with said reciprocating tamper foot means for smoothing out the stress joint formed by said joint smoothing means.

4. In the jointer of claim 3 wherein said joint smoothing means includes a smooth trough on the underside of said housing.

5. In the jointer of claim 4 wherein said reciprocating tamper foot means includes a pair of spaced crankshafts rotatably mounted on said housing, a motor shaft rotated by said motor, a pair of spaced pulleys interconnected by a resilient belt mounted on said housing, one of said pulleys being rotated by said motor shaft and the other of said pulleys being coupled to a first sprocket for rotating the latter, said first sprocket being coupled to one of said crankshafts for rotating the same, the other of said crankshafts being connected to the other of said sprockets, a chain interconnecting said sprockets, and a tamper foot coupled to both of said crankshafts.

6. In the jointer of claim 5 wherein each of said crankshafts includes a generally centrally located offset crank portion having said tamper foot connected thereto whereby said tamper foot reciprocates when said crankshafts are rotated.

7. In the jointer of claim 5 wherein said tamper foot terminates in a point extending downwardly through a slot formed in the underside of said housing, said stress joint preforming means including a ridged portion on the underside of said housing, said tamper point, said ridged portion and said smooth trough all being generally linearly aligned.

8. In the jointer of claim 7 including resilient wipers mounted on the underside of said housing adjacent said slot therein engaging said tamper point substantially closing off the opening of said slot to provide a wiping action on said tamper point when it reciprocates.

9. In the jointer of claim 8 wherein said motor is self contained on said jointer and includes a fuel supply therefor.

10. In the jointer of claim 8 including pulling means engaging said housing for guiding said jointer in a generally linear path when said motor is actuated.

* * * * *